United States Patent [19]

Tange

[11] Patent Number: 4,995,614

[45] Date of Patent: Feb. 26, 1991

[54] GOLF BALL DISPENSER AND SETTER

[76] Inventor: Mark L. Tange, 14991 Coutolenc Rd., Magalia, Calif. 95954

[21] Appl. No.: 567,165

[22] Filed: Aug. 13, 1990

[51] Int. Cl.[5] ..... A63B 57/00

[52] U.S. Cl. ..... 273/201

[58] Field of Search ..... 273/201

[56] References Cited

U.S. PATENT DOCUMENTS

| | | | |
|---|---|---|---|
| 3,599,983 | 8/1971 | Melton . | |
| 3,778,067 | 12/1973 | Gentiluomo . | |
| 3,966,213 | 6/1976 | Bradley | 273/201 |
| 4,355,811 | 10/1982 | Williams, Sr. . | |

*Primary Examiner*—Theatrice Brown

[57] ABSTRACT

A lightweight, manually portable apparatus includes an adjustable, horizontally disposed base having a vertically rising, and partially transparent ball storage housing affixed thereto. The storage housing is internally baffled to store a number of balls in a zigzagging, vertically rising single column. A pivotally attached ball selector is positioned adjacent a ball dispensing aperture of the storage housing. The selector will allow the separation of one ball at a time from the single column of stored balls. After selection, the selected ball rolls downhill and leaves the storage housing to come to rest against a first end of an elongated pivotally attached vertical delivery chute. The delivery chute pivots downward under the weight of the ball resting thereon. The ball rolls downhill toward a second end of the chute and drops through an aperture in the delivery chute to be deposited onto a playing surface. A counterweight attached to the first end of the chute causes the chute to pivot back to a vertical position after setting the ball. The delivery chute is disengagable when struck by a golf club, and the selector is specifically structured to maintain the stored balls within the storage housing with the delivery chute disengaged from the apparatus.

6 Claims, 5 Drawing Sheets

GOLF BALL DISPENSER AND SETTER

BACKGROUND OF THE INVENTION

1. Field of the Invention

This invention relates to the game of golf and equipment therefor, and more particularly to an improved apparatus for mechanically setting a golf ball onto a tee or other playing surface in preparation for hitting the ball with a golf club.

2. Description of the Prior Art

Past art devices structured to place golf balls onto tees, may be placed in two general categories. The first category generally consists of golf ball setting equipment positioned wholly or in part underground, and structured for setting the ball on a golf tee, followed by raising the tee and ball to above ground level for play. The second category generally consists of portable equipment which is positioned generally above ground. The above ground ball setting equipment is structured to lower a golf ball onto on a stationary tee or other playing surface, followed by retracting out of the way of the golfer's swing.

Examples of underground type golf ball setters are found in U.S. Pat. No. 4,355,811 issued Oct. 26, 1982 to Louis E. Williams, Sr., and in U.S. Pat. No. 3,778,067 issued Dec. 11, 1973 to Joseph A. Gentiluomo. The inherent disadvantages of the underground type of apparatus is that they are generally stationary in design, have many moving parts, are relatively expensive to build, install and maintain.

Prior art representing an above ground ball setter is found in U.S. Pat. No. 3,599,983 issued Aug. 17, 1971 to Raymond L. Melton. Melton's portable golf ball setter uses a funnel-like hopper for storing a plurality of golf balls as a supply for feeding the setting portion of the apparatus. Melton's funnel-like storage hopper has been found to be unreliable, in that the balls have a tendency to bind or jam periodically against themselves within the hopper, and consequently fail to dispense properly therefrom.

Melton uses a pivotally mounted ball delivery ramp to deliver a single ball onto a golf tee. The delivery ramp is structured with a counterweight designed to retract the ramp out of the way of the golfer's club swing after the ball is set. Melton's delivery ramp is so mounted on its carriage as to allow its dislocation in the event of an inadvertent conflict with an errant club swing. The disengagable delivery ramp is intended to help prevent accidental damage to the apparatus, however, Melton has placed his golf ball selector means, that which selects one ball at a time and prevents additional stored balls from entering the delivery ramp, on one end of his disengagable ball delivery ramp. If for whatever reason, the delivery ramp is dislocated from the base of the machine, whatever number of balls that are held in the machine, including all hopper-stored balls would be dumped out of the machine and onto the ground. The dislocation of Melton's delivery ramp would allow whatever number of balls left in the apparatus, which could be a substantial number, to be deposited on the ground immediately toward the feet of the golfer, this is of course assuming the balls did not jam in the funnel-like ball storage hopper. The dumping of a large number of golf balls at the golfer's feet would obviously create a safety hazard, a substantial liability risk, and expend the golfer's time and energy in retrieving and replacing the loose golf balls. The Melton golf ball setter also appears quite elongated, a shape and structure which, unless dismantled would require a substantial amount of floor space for storage of the unit in places such as closets and the like when not in use.

SUMMARY OF THE INVENTION

The improved golf ball dispenser and setter of this disclosure is to assist the practicing golfer in terms of saving time and energy by semi-automatically dispensing and setting a golf ball onto a practice tee or other playing surface. The semi-automatic setting of a golf ball alleviates the need of the golfer to move his feet or grip position on the club which, in turn, allows for a minimal loss in concentration between practice shots, and the need to repeatedly bend over.

My above ground type golf ball setter is highly portable, weighing less than twenty five pounds, and is affixed with a carrying handle to allow the device to be easily manually carried by hand. The structure includes a stabilizing base affixed with adjustable legs for leveling the apparatus prior to use, and a vertically rising, partially transparent, ball storage housing affixed to the upper surface of the base. The ball storage housing is internally baffled to store a large number of golf balls in a zigzagging, vertically rising single column, eliminating the possibility of the balls jamming in the storage housing.

My apparatus further includes a pivotally attached ball selector positioned in part within the lower end of the ball storage housing adjacent a ball dispensing aperture of the housing. My ball selector is generally independent of the other major components of the ball setter, being specifically structured to allow the passing of only one ball at a time, and only when intentionally actuated. The ball selector when actuated, is structured to allow one ball to separate from the column of stored balls and roll downward under the pull of gravity from within the ball storage housing. The single selected golf ball leaves the storage housing through the housing dispensing aperture and comes to land on a first end of an elongated U-shaped, pivotally attached vertically oriented delivery chute. The delivery chute pivots downward under the weight of the dispensed golf ball resting thereon. As the delivery chute pivots and begins to angle downward, the golf ball rolls on the chute. The ball rolls downhill toward a second end of the chute, where the ball drops through an aperture in the delivery chute and is deposited onto either the top of an aligned golf tee or other playing surface. Upon the weight of the ball leaving the delivery chute, a counterweight attached to the first end of the chute causes the chute to pivot or retract back to a generally vertical position, hopefully clear of any wild swings by the golfer. My delivery chute is retained in a manner to allow the chute to disengage when struck by a wide golf swing, and the selector is specifically structured to maintain the stored balls within the ball storage housing even with the delivery chute disengaged.

The relatively small size of my stabilizing base, coupled with and made possible by the vertically rising ball storage housing, and the elimination of the possibility of the stored balls from inadvertently being dumped from the storage housing, allows my device to be easily transported and stored in a small area with a supply of golf balls conveniently stored in the storage housing.

Once the golf ball setter and dispenser is setup and leveled on a suitable playing surface, and the ball storage housing has been initially loaded with a quantity of golf balls, the golfer may direct his attention to play, for instance his stance, the appropriate golf club and his grip on the club. He then merely places the head of his club on a trigger pad of my ball setter, and pushes downward, this without changing his foot position or grip on the club. This downward push on a trigger pad activates a pivotal linkage arrangement which in turn actuates the ball selector which releases one golf ball from the storage housing, and the ball is set onto the top of a golf tee or other playing surface such as the ground or the floor within a building. Even if the trigger pad is retained depressed by the golfer for an extended period of time, the ball selector will only separate and allow the passing of one ball until the trigger pad is released to allow the resetting of the ball selector back into its first position. After the dispensing of a ball and the release of the trigger pad, the set golf ball may be hit by the player, and the single ball release and setting process may be repeated until the stored balls are all used. At that point, the ball storage housing may be reloaded, and the player may continue playing, or he may grasp the handle of the setter and carry it to a suitable location such as a closet for storage.

Therefore a primary object of the invention is to provide an improved golf ball dispenser and setter which operates semi-automatically to set a golf ball onto the top of a tee or other playing surface.

A further object of the invention is to provide the above in an apparatus which is capable of storing a large number golf balls positioned ready for dispensing.

A further object of the invention is to provide the above in an apparatus which stores the large number of balls in a vertical storage housing, with the housing having internal baffles to contain the golf balls in a zigzagging, vertically rising single column.

A further object of the invention is to provide the above in an apparatus which includes a ball selector structured to separate a single ball at a time from the single column of stored balls.

A further object of the invention is to provide the above in an apparatus which includes a pivotally attached delivery chute which is capable of disengaging from the apparatus.

A further object of the invention is to provide the above in an apparatus which includes a ball selector which is capable of retaining the remaining golf balls stored in the housing with the delivery chute disengaged from the apparatus.

A still further object of the invention is to provide the above in an apparatus which is dependable in use, relatively inexpensive to build, and which boxes well for shipping and handling.

Further objects and advantages of my invention will become apparent with a continued reading of the specification and an examination of my included drawings.

DESCRIPTION OF THE PREFERRED EMBODIMENT

Figure 1:
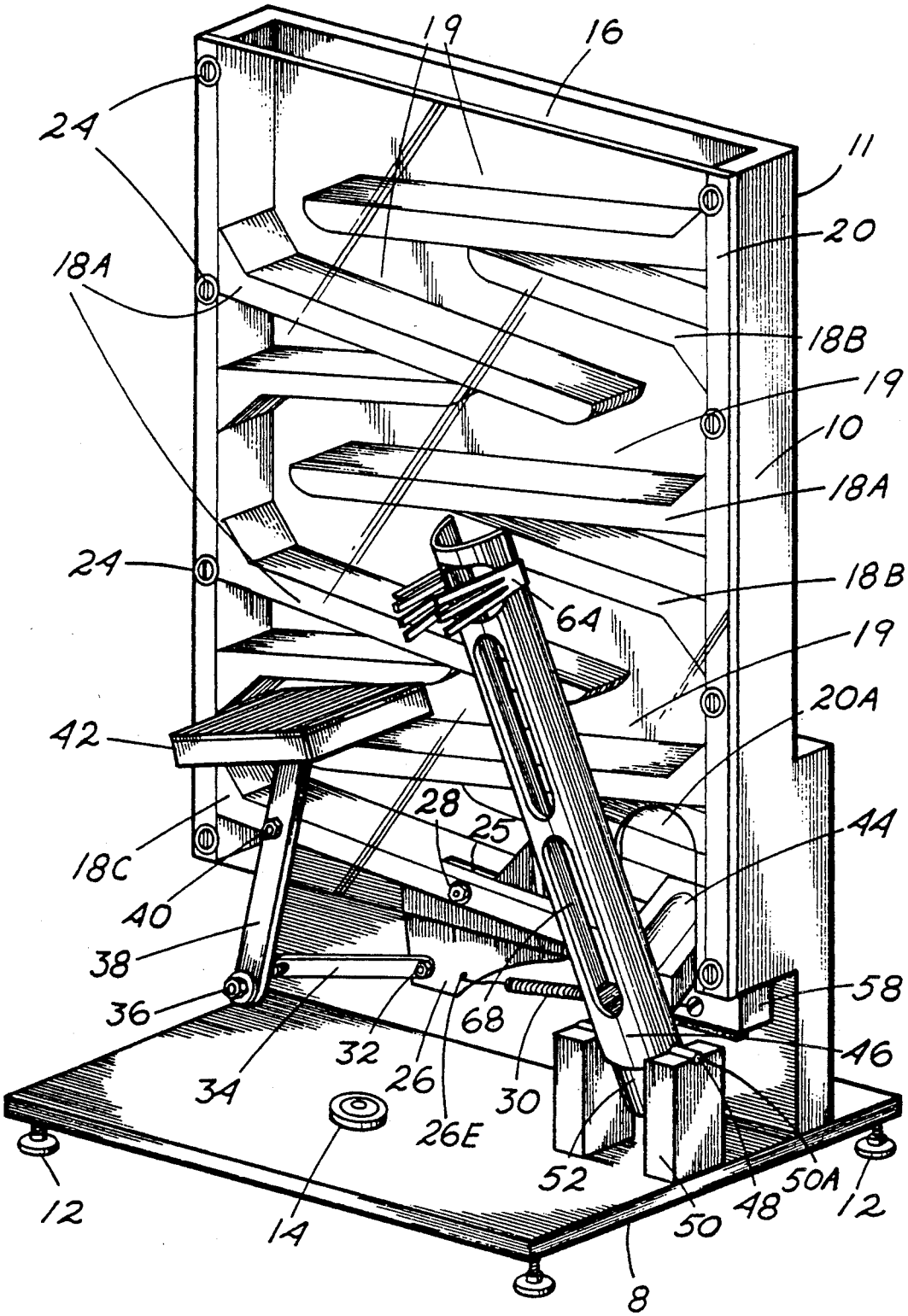
FIG. 1 is a perspective view of the apparatus from the upper right front.

Referring now to the drawings in general. My golf ball dispensing and setting apparatus is generally comprised of a horizontally disposed stabilizing base 8, and a vertically rising ball storage housing 10 attached at a ninety degree angle to base 8. Both base 8 and storage housing 10 are constructed out of a rigid material which is lightweight and durable, such as a plastic, metal, or wood for example. A handle 70 is attached to back panel 11 of ball storage housing 10 to allow convenient carrying of the lightweight apparatus with one hand by an adult.

Attached to the bottom side of base 8 are a plurality of leveling support legs designated height adjusters 12. Height adjusters 12 are adjustably mounted feet having threaded shanks threadably engaged in threaded bores in downward extensions 13 of base 8. Downward extensions 13 provide sufficiently elongated threaded bores to allow a wide degree of inward and outward adjusting of height adjusters 12. By rotatably adjusting the position of each of the height adjusters 12 from base 8, base 8 may be leveled on a playing surface, which in turn vertically plumbs ball storage housing 10 assuring proper slopes within the apparatus for dependable operation thereof. At least three height adjusters 12 appear necessary, although four are preferred for improved stability. Height adjusters 12 should rotate to be adjusted by the hand of the golfer without a tool, yet be frictionally restrained sufficiently to avoid inadvertent rotation by the continued operation and vibration of the apparatus. A leveling indicator 14 of the liquid and bubble type, may be included as an attached, integral feature of the apparatus, or merely used temporarily during the initial leveling of the apparatus prior to use.

Ball storage housing 10 is a rectangular tube, rigidly attached to the upper side of base 8. At least front panel 20 of ball storage housing 10 is preferred to be made of transparent plastic to allow viewing of golf balls 22 stored in the housing 10. Panel 20 may be attached to the side walls of ball storage housing 10 using screws and washers 24 or other suitable fasteners.

Within ball storage housing 10 are a plurality of elongated baffles. The baffles extend widthwise from the interior surface of panel 20 across to the interior surface of back panel 11 of ball storage housing 10. As shown in FIG. 1, the internal baffles are designated load bearing baffles 18A, non-load bearing baffles 18B, and baffle 18C, which is the lower most load bearing baffle adjacent base 8. Load bearing baffles 18A support the weight of golf balls 22. Non-load bearing baffles 18B are positioned above and in spaced relationship to baffles 18A to prevent one stored ball 22 from transcending balls 22 downhill before it, shown best in FIG. 2 and 4. Baffles 18A and 18B are attached at one end thereof to the interior side wall of ball storage housing 10, angling toward the oppositely disposed interior side wall of ball storage housing 10. Baffles 18A terminate prior to reaching the side wall opposite the side wall to which they are attached. The space remaining between the terminal ends of baffles 18A is sufficient to allow the passage of a golf ball between the terminal end thereof and the interior side wall. Baffles 18B terminate against the bottom side of baffles 18A as shown in the drawings. Baffles 18A all slope at a downward angle toward base 8 at a sufficient degree to provide a reliable gravity forced rolling transfer of golf balls 22, while baffles 18B slope upward, positioned above baffles 18A. The spacing between baffles 18A and 18B is generally equal to that of the diameter of a golf ball 22, with a small amount of extra free space provided to assure free rolling of balls 22 between the baffles 18A and 18B.

Figure 4:
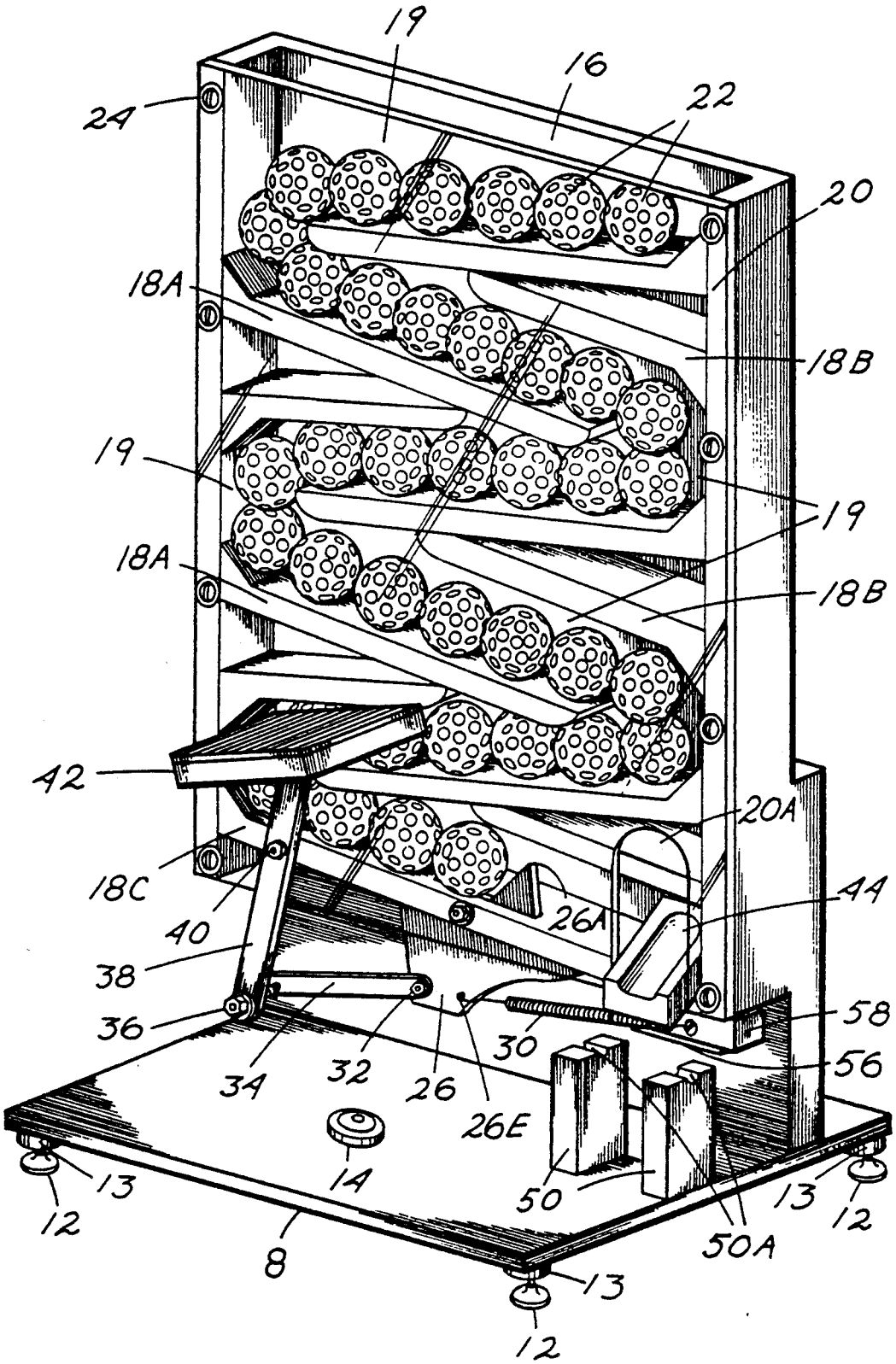
FIG. 4 is perspective view of the invention fully loaded with golf balls which are seen through the transparent front panel of the ball storage housing. The ball delivery chute is disengaged and not shown in this view to illustrate the retainment of the stored balls in the absence of the delivery chute.

The placement of baffles 18A and 18B within ball storage housing 10 provides an open channel 19. Open channel 19 is a zigzagging open channel structured to guide and organize a plurality of golf balls 22 placed in ball storage housing 10 into a zigzagging, vertically rising single column of balls 22 as shown in FIG. 4. The zigzagging, vertically rising single column of stored golf balls 22 provides for a large number of balls 22 to be stored in a relatively small space, and has proven to be a "jam" free arrangement.

Ball storage housing 10 is open at the top end thereof to allow the installation of golf balls 22. The opening is designated ball installation opening 16, with opening 16 also capable of being used to quickly remove the balls 22 from storage housing 10 by manually picking the apparatus up, and inverting it to allow all stored balls 22 to roll out of housing 10. Opening 16 is in communication with the upper end of open channel 19, and ball dispensing aperture 20A is in communication with the lower end of open channel 19. An openable door over opening 16 of course may be used, but is not seen to be necessary at this time. To install golf balls 22 into ball storage housing 10, balls 22 are simply dumped into housing 10, and baffles 18A and 18B guide, organize, and retain the balls 22 into a zigzagging single column.

When a plurality of golf balls 22 are stored within ball storage housing 10, the balls 22 are prevented from exiting housing 10 through ball dispensing aperture 20A in cover panel 20 by a specifically shaped plate designated selector 26. Selector 26 is positioned in part in baffle 18C shown best in FIG. 2A. Selector 26 is positioned between ball dispensing aperture 20A and the column of stored balls 22 within open channel 19. Selector 26 should be made of a generally thin, rigid material such as plastic or metal, and is shaped as shown in the front view thereof in FIG. 2B. A plate material of about ⅛ to ¼ inch thick is adequate from which to manufacture selector 26.

Selector 26 is positioned through a generally centered, elongated aperture or slot 25 Which extends upward through baffle 18C shown best in FIG. 1. Selector 26 is pivotally attached with a bolt 28 through aperture 26F in selector 26. Bolt 28 extends through panel cover 20, baffle 18C and back panel 11, and is secured in place with a nut. Bolt 28 serves as an axle for selector 26 to rotate on, and is sized slightly smaller in diameter than aperture 26F. Pivotal attachment structures other than bolt 28 of course may be used to pivotally mount selector 26.

Figures 2A, 2B:
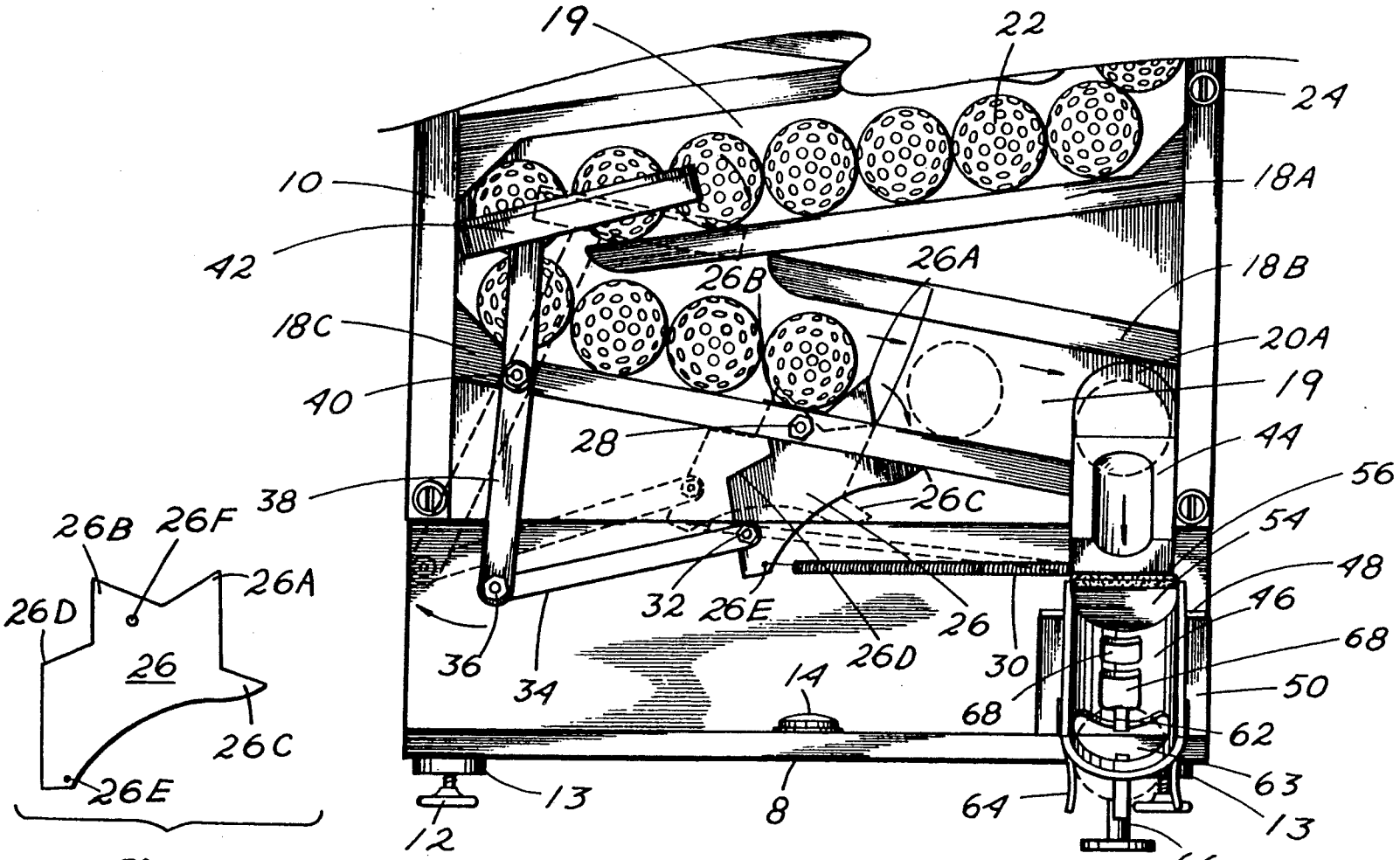
FIG. 2A is a partial front view of the lower portion of the invention with the ball selector in the first position in solid lines, and in the second position in broken lines. The ball delivery chute is shown in the lower position.
FIG. 2B is a front view of the specifically shaped ball selector by itself.

As seen in FIGS. 2A and 2B, selector 26 is structured to provide a forward ball stop tooth 26A, a rearward ball stop tooth 26B, a forward pivot stop shoulder 26C and a rearward pivot stop shoulder 26D. Slot 25 in baffle 18C extends parallel with the longitudinal dimension of baffle 18C, and should be made only long enough and wide enough relative to the dimensions of selector 26 to provide sufficient clearance for unhindered operation of the selector. The dimensions of selector 26 will in-part depend on the thickness of the material used for baffle 18C. As can be seen in FIG. 2A, whatever thickness material is used for baffle 18C, forward ball stop tooth 26A should be at its apex when forward pivot stop shoulder 26C is abutted against the bottom surface of baffle 18C beyond the length of slot 25. Furthermore, the dimensions of selector 26 will depend in-part on the rearward ball stop tooth 26B being at its apex when rearward pivot stop shoulder 26D is abutted against the bottom surface of baffle 18C beyond the length of slot 25. The abutments of forward pivot stop shoulder 26C and rearward pivot stop shoulder 26D are made possible by the length of selector 26 across its width between the terminal ends of stop shoulders 26C and 26D being wider than the length of slot 25. Aperture 26F in selector 26 for bolt 28 is placed so that when forward ball stop tooth 26A is at its apex with forward pivot stop shoulder 26C abutted against the bottom surface of baffle 18C, the rearward ball stop tooth 26B is recessed slightly below the top surface of baffle 18C. Alternatively, the pivot point of selector 26 is placed so that when rearward ball stop tooth 26B is at its apex with rearward pivot stop shoulder 26D abutted against the bottom surface of baffle 18C, forward ball stop tooth 26A is recessed slightly below the top surface of baffle 18C. Forward ball stop tooth 26A and rearward ball stop tooth 26B when in the raised positions above the top surface of baffle 18C should protrude high enough into open channel 19 to reliably and consistently stop the series of golf balls 22 within ball storage housing 10 in their gravity forced rollable path. Forward ball stop tooth 26A and rearward ball stop tooth 26B form a "V" configuration which acts to select a ball 22, and control the downward, rollable movement of the selected golf ball 22, and the other stored balls 22 the path through the apparatus. Forward pivot stop shoulder 26C and rearward pivot stop shoulder 26D should be prominent enough to limit the forward and rearward rotation of selector 26 at its extreme alternate positions when in operation. In FIG. 2A, selector 26 is shown in solid lines at its forward or "first" position preventing the release of the first ball in the column with the upward extended tooth 26A. Also in FIG. 2A, selector 26 is shown in dotted lines at its retracted or "second" position to allow the passage of a single golf ball 22 from within the "V" of the selector 26. With selector 26 retracted, the second golf ball 22 in the column of balls is prevented from following the selected ball by the now upwardly extending rearward ball stop tooth 26B. After a single ball 22 has been allowed to pass through selector 26, selector 26 is returned by an extension spring 30 to its first or normal position, limited in its returning motion by the abutment of forward pivot stop shoulder 26C against the bottom surface of baffle 18C.

Return spring 30 is attached at one end thereof to point 26E of selector 26, and the opposite end of spring 30 is attached to any suitable location which will allow spring 30 to return selector 26 to its first position after the passage of a single ball 22. In the drawings, the other end of spring 30 is attached to stop block 58. The strength of spring 30 should be sufficient to return and retain selector 26 in its first position, yet not so strong as to require more than a slight depressing effort by the golfer with the end of his hand 72 held golf club 74 to activate the apparatus. The actuation of selector 26 will be detailed further.

As shown best in FIGS. 1 and 2A, selector 26 is attached to one end of selector linkage 34, a flat, horizontally oriented rigid plate or bar, by a pivotal connection designated linkage pivot 32. Linkage pivot 32 may be made using a bolt through apertures in linkage 34 and selector 26, and with washers and a nut. The oppositely disposed end of selector linkage 34 is pivotally attached to trigger lever 38, which is a rigid, vertically oriented flat plate or bar. The connection between lever 38 and linkage 34 is made by linkage pivot 36, which may also be a bolt, washer and nut arrangement. As shown in FIG. 1, and partially shown in FIG. 3, the bolt or axle used to form the linkage pivot connection 36 is elongated to provide an offset between the linked together ends of linkage 34 and trigger lever 38, with the offset necessary due to the plane in which selector 26 rests, relative to the plane in which trigger lever 38 rests.

At a point somewhat centered between the two oppositely disposed ends of trigger lever 38, lever 38 is pivotally attached to baffle 18C at the trigger pivot 40. Trigger pivot 40 may be a bolt set through ball storage housing 10. As shown in FIG. 2A, the affixment of trigger lever 38 is off to one side of ball storage housing 10 with the lever 38 extending upward generally vertically, but at a slight angle. The slight angle of lever 38 positions the upper end thereof more toward the center of storage housing 10 than the bottom end of the lever 38. This angling assures the proper direction of movement when trigger lever 38 is actuated by the golf club 74 of a golfer. The closest to a vertical position trigger lever 38 may reach is determined by the abutment of forward pivot stop shoulder 26C of selector 26 against the bottom surface of baffle 18C.

As shown in FIG. 1, affixed to the upper end of trigger lever 38 is a trigger pad 42. Trigger pad 42 is securely attached to the trigger lever 38 to withstand the rigors of continual use. Trigger pad 42 should be of a size to allow the setting of a golf club 74 on its top surface with a large margin for error of golf club 74 placement. At least the top surface material used for trigger pad 42 should be of a resilient, non-slip nature, such as plastic or rubbery material, yet not of a hardness which could scratch or mar golf club 74. Trigger pad 42 and the top end of the trigger lever 38 are set and attached at an angle which would best accommodate as close to a vertical motion as possible when used to direct movement of the golf club 74 in a downward motion rather than from side to side. This will help alleviate the apparatus from moving from its set position due to the operational force necessary to activate trigger lever 38.

Figure 3:
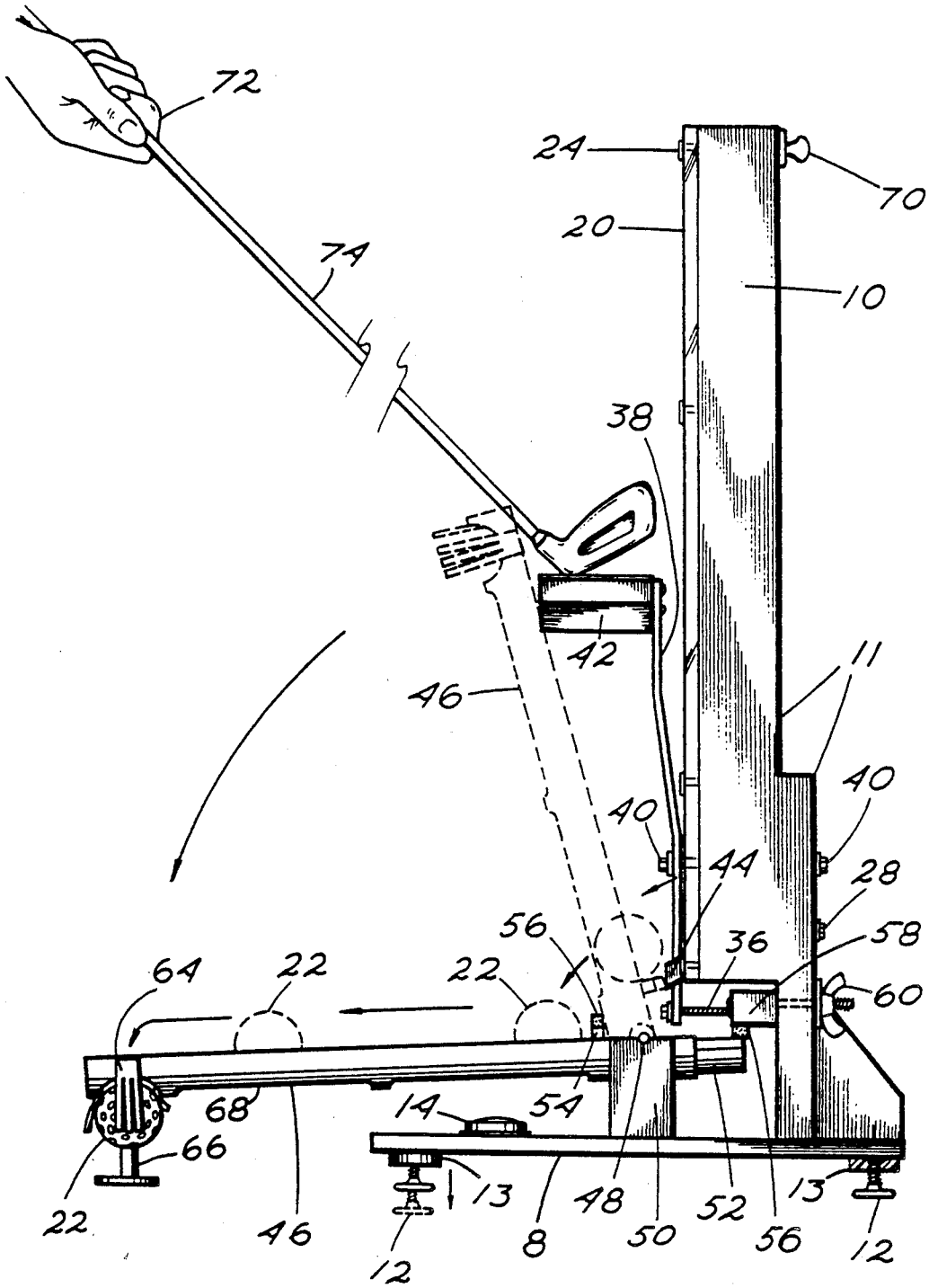
FIG. 3 is the right side view of the invention showing the alternate delivery chute positions in solid and broken lines, and the actuation of the ball delivery mode by a golfer with his golf club.

Referring now to FIG. 2A and 3. In order to activate selector 26 to release a single ball 22 from the column of stored balls 22, a golfer places his club 74 against the top of trigger pad 42 and presses downward. With downward pressing, trigger lever 38 pivots, thereby pulling linkage 34, defeating spring 30, which in turn retracts selector 26 allowing a single ball 22 to pass. The golfer then pulls his club 74 from trigger pad 42, and spring 30 returns both selector 26 and trigger lever 38 to the normal position. Even if the golfer maintains trigger pad 42 downward after one ball 22 has been released, rearward ball stop tooth 26B will prevent any additional balls 22 from passing as may be ascertained from closely examining the dotted line drawing of selector 26 in FIG. 2A.

After a single ball 22 has been allowed to pass beyond selector 26, the selected ball 22 rolls from baffle 18C onto a short loading ramp 44. Loading ramp 44 is attached at the lowest end of baffle 18C to allow the ball 22 to roll from baffle 18C onto ramp 44. Loading ramp 44 is positioned partially within open channel 19 and partially extending through ball dispensing aperture 20A, and may be considered a part of the baffles which form open channel 19. Loading ramp 44 has a greater downward pitch than that of baffles 18A and 18C, and is set perpendicular to baffle 18C to alter the downward, rolling path of the selected golf ball 22 through ball dispensing aperture 20A shown best in FIG. 4. Loading ramp 44 may be made with an elongated trough shaped surface on its upper side to better direct the path of the golf ball 22.

Pivotally attached adjacent the distal end of loading ramp 44 is an elongated, U-shaped or trough-like delivery chute 46 which is structured to receive and guide a ball 22 from loading ramp 44, with the weight of the received ball 22 causing chute 46 to pivot downward, with the downward pivoting causing the ball 22 to roll toward the second or distal end of chute 46 where the ball 22 is first slowed in its rolling rate by having to roll over the top of a flexible finger brake 62 subsequent to dropping downward through an aperture 63 in the distal end of delivery chute 46. As the ball 22 drops through aperture 63, a plurality of flexible extensions or fingers 64 surrounding the underside of aperture 63 stabilize the falling ball 22 against any side to side motion to allow setting the ball onto the top of an aligned golf tee 66 in such a manner that the ball will remain on the top of tee 66. Extensions 64 function similar to the netting around a basket ball hoop. After the ball is set, a counterweight 52 retracts chute 46 back into a near vertical position. As shown in FIG. 1, delivery chute 46 may be lightened with holes 68 in the bottom surface of the chute 46.

Delivery chute 46 can best be seen in FIG. 1 in a retracted state, and in FIG. 2A in a lowered state. FIG. 3 shows delivery chute 46 in a lowered state in solid lines over a tee 66, and in a retracted state in dotted lines. As can best be seen in FIG. 3, delivery chute 46 may pivot on delivery chute pivot axle 48 attached to first end of chute 46 adjacent storage housing 10, from a near vertical or retracted position to a less than horizontal or lowered position. In the lowered position, the distal end of delivery chute 46 is lowered below axle 48 and the first end of the chute 46. Delivery chute 46 is supported near its first end by axle 48 which extends outward from two oppositely disposed side edges of chute 46. Axles 48 may be made of steel. Axle 48 rests on top of two chute support blocks 50 which are attached to the top surface of base 8. Each support block 50 has a notch 50A at the top end thereof to releasably receive and retain axle 48 with chute 46 positioned between the two blocks 50. Axle 48 rests loosely in notches 50A, with the loose resting therein allowing chute 46 to be easily disengaged or removed when struck by a wild golf swing or lifted by hand. In FIG. 4, delivery chute 46 is removed from blocks 50, and notches 50A for axle 48 may be easily viewed.

Delivery chute 46 in its normal position rests in a near vertical position due to the weight distribution adjusted through the use and placement of counterweight 52. Chute 46 is automatically retracted to the near vertical position after a ball 22 leaves the chute 46 by counterweight 52 affixed to the first end of chute 46. Counterweight 52 pulls chute 46 to a near vertical position, with the limit to which delivery chute 46 may approach a vertical position being controlled by a stop block arrangement. The stop block arrangement is comprised of an extending block 54 attached within the "U" of chute 46 between axle 48 and the distal end of chute 46, with block 54 aligned to abut the distal end of loading ramp 44 best seen in FIG. 3. Block 54 is padded on its distal end with padding 56 to serve as a vibration dampener. As counterweight 52 causes delivery chute 46 to pivot or retract toward a vertical position after the delivery of a ball 22 onto a playing surface, padding 56 of block 54 abuts the distal end of loading ramp 44 and prevents chute 46 from reaching a completely vertical position. The near vertical, yet slightly angled position of chute 46 in its normal position is that the distal end of the chute 46 leans more toward the playing surface or tee 66 than the weighted first end of the chute 46. The near vertical positioning of delivery chute 46 assures the chute 46 of pivoting in the proper direction toward the playing surface upon receiving the weight of a ball 22. As may be ascertained from the drawings, block 54 is positioned in chute 46 so that when chute 46 is in the near vertical position with pad 56 and block 54 abutted or directly adjacent the ball dispensing end of loading ramp 44, block 54 is positioned slightly below the top surface of ramp 44. When a ball 22 leaves ramp 44, the ball 22 drops onto block 54 which serves as a floor on which the ball may momentarily rest as chute 46 begins to pivot downward under the weight of the ball 22.

Figure 5:
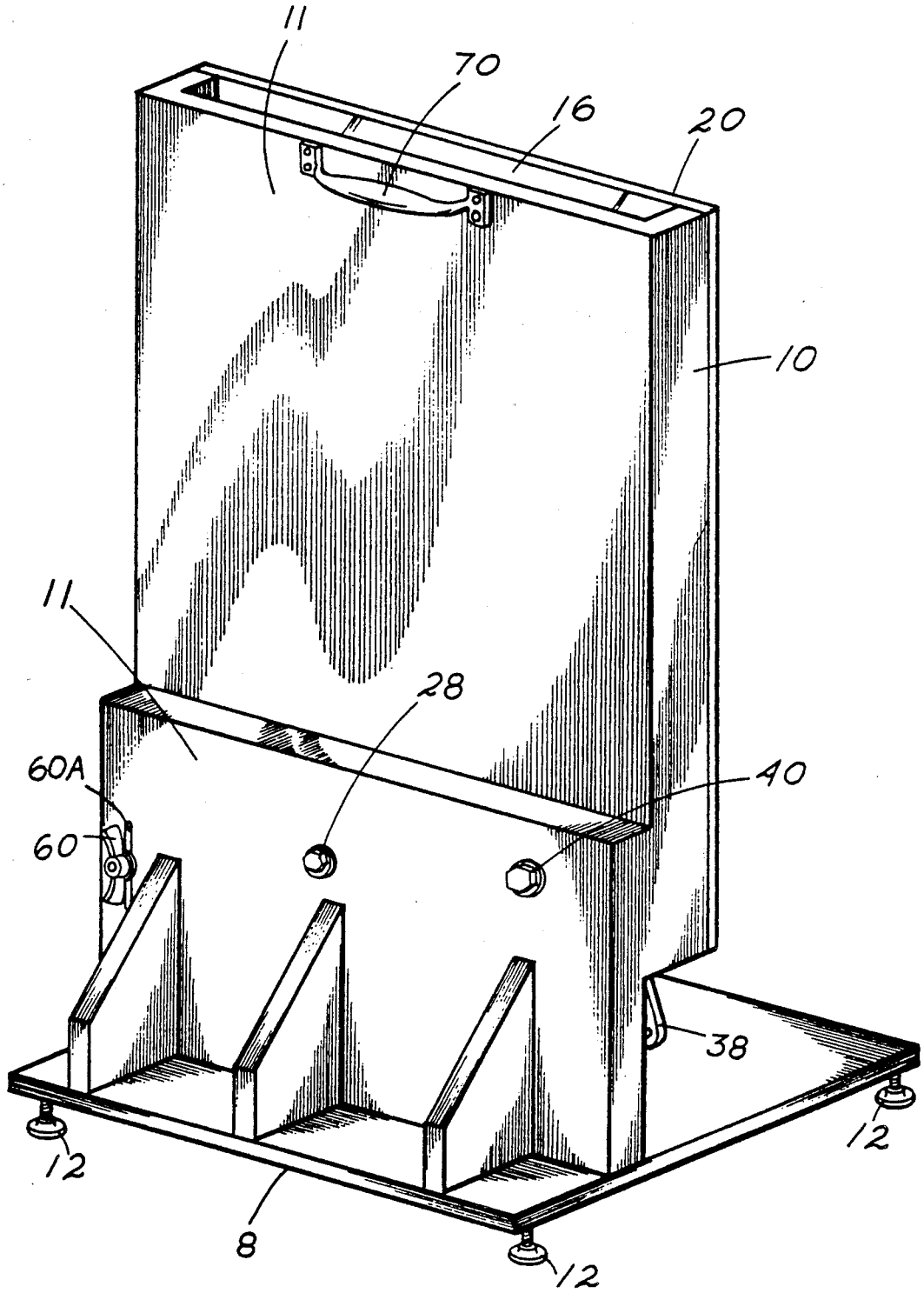
FIG. 5 is a rear perspective view of the invention.

The degree to which delivery chute 46 may angle downward to place a ball 22 onto a playing surface is controlled by a second stop block arrangement. This second stop block arrangement is comprised of stop block 58 adjustably attached to ball storage housing 10 directly below loading ramp 44. Stop block 58 also has padding 56 affixed thereto to serve as a vibration dampener. Stop block 58 is aligned and positioned to provide an abutment surface for counterweight 52 to strike as delivery chute 46 moves into a downwardly sloped position to set a ball 22 onto a playing surface. The abutment of counterweight 52 against padding 56 on the underside of stop block 58 restricts the degree of downward slope delivery chute 46 may reach. This degree of downward slope is adjustable to allow a player to set delivery chute 46 to either set a ball 22 onto the top of a golf tee 66, or onto the floor or ground. Delivery chute 46 must be allowed to pivot into a steeper slope to set a ball 22 onto a floor or ground playing surface as opposed to an extending tee 66. In order to allow the degree of downward slope chute 46 must reach in setting a ball 22, stop block 58 is adjustably positioned. As shown in FIGS. 3 and 5, stop block 58 is adjustably attached to a lower portion of ball storage housing 10, and more precisely back panel 11, using a bolt and wing nut 60 arrangement through an elongated vertically oriented slot 60A in back panel 11. By loosening the wing nut, stop block 58 may be repositioned upward or downward, thus controlling the maximum down slope delivery chute 46 may reach when setting a ball 22.

Delivery chute 46 has a length suited to delivering a golf ball 22 to a golf tee 66 a sufficient distance away from base 8 to provide for clearance for the golfer's club swing, and chute 46 when it is in its near vertical position for the apparatus not to be a distraction for the golfer. Delivery chute 46 may be made of a lightweight and somewhat resilient plastic to provide durability of the part.

The materials used to manufacture the individual components of the invention should all be durable and lightweight in order to keep the total weight of the apparatus to less than 25 pounds, and allow the apparatus to operate suitably for a reasonable number of years.

Although I have very specifically described the preferred structures of the invention, it should be understood that the specific details are just that, "preferred" structures given for example to those skilled in the art. Many minor changes in the specific structures described may obviously be made without departing from the scope of the invention, and therefore it should be understood that the scope of the invention is not to be limited by the specification and drawings given for example, but is to be determined by the spirit and scope of my appended claims.

What I claim as my invention is:

1. An improved golf ball dispenser and setter apparatus sufficiently lightweight to be carried by hand, comprising;

a stabilizing base having a golf ball storage housing affixed to a top side thereof, said storage housing being a generally rectangular structure having internal baffles, said storage housing in an upper end thereof having an access opening providing means to allow insertion of golf balls into said storage housing, said storage housing having a ball dispensing opening positioned in a lower end thereof, said internal baffles positioned within said storage housing to form a vertically rising zigzagging open channel extending between said access opening and said ball dispensing opening, said zigzagging open channel sized and structurally arranged to organize and guide golf balls inserted into said storage housing through said access opening into a vertically rising zigzagging single column of golf balls;

a golf ball selector means, said selector means being a movably mounted member extending into said zigzagging open channel at said lower end of said storage housing, at least a portion of said selector means shaped and positioned within said zigzagging open channel to prohibit the passing of golf balls beyond said selector means and out said ball dispensing opening with said selector means in a first position, said selector means further structured to be repositioned into a second position, said selector means having means to select and allow passage of a single golf ball from a zigzagging single column of golf balls within said storage housing with repositioning of said selector means from said first position to said second position, ball directing means to direct a selected golf ball through said ball dispensing opening;

selector positioning means, said selector positioning means being a pivotal lever and linkage arrangement connected to said selector means, said selector positioning means including a pad positioned to allow pressing thereon by a golf club, said selector positioning means having means to reposition said selector means from said first position to said second position upon pressing on said pad;

biasing means of returning said selector means from said second position to said first position;

a ball delivery chute removably and pivotally affixed adjacent said ball dispensing opening, said ball delivery chute positioned to receive a golf ball exiting said storage housing through said ball dispensing opening, said ball delivery chute having means actuated by receipt of a golf ball to pivotally move over a playing surface and to deposit the received golf ball onto the playing surface;

biasing means providing retraction of said ball delivery chute after depositing of a golf ball onto a playing surface;

said selector means further having means preventing inadvertent passage of golf balls with said ball delivery chute removed.

2. An improved golf ball dispenser and setter apparatus according to claim 1 wherein said biasing means of returning said selector means includes an extension spring.

3. An improved golf ball dispenser and setter apparatus according to claim 1 wherein said biasing means providing retraction of said ball delivery chute includes a weight.

4. An improved golf ball dispenser and setter apparatus sufficiently lightweight to be carried by hand, comprising;

a golf ball storage housing on a stabilizing base, said storage housing having an access opening providing means to allow insertion of golf balls into said storage housing, said storage housing having a ball dispensing opening;

a golf ball selector means, said selector means being a movably mounted member extending into said storage housing, at least a portion of said selector means shaped and positioned within said storage housing to prohibit the passing of golf balls beyond said selector means and out said ball dispensing opening with said selector means in a first position, said selector means further structured to be repositioned into a second position, said selector means having means to select and allow passage of a single golf ball from golf balls within said storage housing with repositioning of said selector means from said first position to said second position, said storage housing having means to direct a selected golf ball through said ball dispensing opening;

selector positioning means, said selector positioning means being a movable linkage arrangement connected to said selector means, said selector positioning means having means to reposition said selector means from said first position to said second position with the repositioning activatable by a person;

a ball delivery chute removably and pivotally affixed to receive a golf ball exiting said storage housing through said ball dispensing opening, said ball delivery chute having means to move over a playing surface and to deposit a received golf ball onto the playing surface;

means providing retraction of said ball delivery chute after depositing of a golf ball onto a playing surface;

said selector means further having means preventing inadvertent passage of golf balls with said ball delivery chute removed.

5. An improved golf ball dispenser and setter apparatus sufficiently lightweight to be carried by hand, comprising;

a golf ball storage housing on a stabilizing base, said storage housing having internal baffles, said storage housing in an upper end thereof having an access opening providing means to allow insertion of golf balls into said storage housing, said storage housing having a ball dispensing opening positioned in a lower end of said storage housing, said internal baffles positioned within said storage housing to form a vertically rising zigzagging open channel extending between said access opening and said ball dispensing opening, said zigzagging open channel sized and structurally arranged to organize and guide golf balls inserted into said storage housing through said access opening into a vertically rising zigzagging single column of golf balls;

a golf ball selector means, said selector means being a movably mounted member extending into said zigzagging open channel at said lower end of said storage housing, at least a portion of said selector means shaped and positioned within said zigzagging open channel to prohibit the passing of golf balls beyond said selector means and out said ball dispensing opening with said selector means in a first position, said selector means further structured to be repositioned into a second position, said selector means having means to select and allow passage of a single golf ball from a zigzagging single column of golf balls within said storage housing with repositioning of said selector means from said first position to said second position, means to direct a selected golf ball through said ball dispensing opening;

selector positioning means providing means to reposition said selector means from said first position to said second position upon actuation by a person;

a ball delivery chute movably affixed to receive a golf ball exiting said storage housing through said ball dispensing opening, said ball delivery chute having means to move over a playing surface and to deposit a received golf ball onto the playing surface.

6. An improved golf ball dispenser and setter apparatus sufficiently lightweight to be carried by hand, comprising;

a golf ball storage housing on a stabilizing base, means to allow insertion of a supply of golf balls into said storage housing, said storage housing having an opening suitable for dispensing a golf ball from within said storage housing;

a golf ball selector means, said selector means positioned at least partially within said storage housing, at least a portion of said selector means shaped and positioned within said storage housing to prohibit the passing of golf balls beyond said selector means and out said opening with said selector means positioned in a first position, said selector means further structured to be repositioned into a second position, said selector means having means to select and allow passage of a single golf ball from golf balls within said storage housing with repositioning of said selector means from said first position to said second position;

selector positioning means, said selector positioning means connected to said selector means, said selector positioning means having means to reposition said selector means from said first position to said second position;

means of activating said selector positioning means to reposition said selector means, said means of activating said selector positioning means being activatable by a person;

a ball delivery chute removably and pivotally affixed to receive a golf ball exiting said storage housing through said opening, said ball delivery chute having means to move over a playing surface and to deposit a received golf ball onto the playing surface;

means providing retraction of said ball delivery chute after depositing of a golf ball onto a playing surface;

means preventing inadvertent passage of golf balls with said ball delivery chute removed.

* * * * *